US008444349B2

(12) United States Patent
Hall

(10) Patent No.: US 8,444,349 B2
(45) Date of Patent: May 21, 2013

(54) GROUTED PILE SPLICE AND METHOD OF FORMING A GROUTED PILE SPLICE

(75) Inventor: Rudolph A. Hall, Madisonville, LA (US)

(73) Assignee: Keystone Engineering Inc., Mandeville, LA (US)

( * ) Notice: Subject to any disclaimer, the term of this patent is extended or adjusted under 35 U.S.C. 154(b) by 68 days.

(21) Appl. No.: 12/793,230

(22) Filed: Jun. 3, 2010

(65) Prior Publication Data

US 2011/0135401 A1 Jun. 9, 2011

Related U.S. Application Data

(60) Provisional application No. 61/183,619, filed on Jun. 3, 2009.

(51) Int. Cl.
*E02D 5/22* (2006.01)
*E02D 7/02* (2006.01)

(52) U.S. Cl.
USPC ..... 405/233; 405/251

(58) Field of Classification Search
USPC ..... 405/231–251
See application file for complete search history.

(56) References Cited

U.S. PATENT DOCUMENTS

| | | | | |
|---|---|---|---|---|
| 1,423,884 | A | 7/1922 | Rush | |
| 2,539,456 | A | 1/1951 | Meier | |
| 3,178,893 | A * | 4/1965 | Fiore | 405/251 |
| 3,199,300 | A * | 8/1965 | Fiore | 405/251 |
| 3,249,664 | A | 5/1966 | Georgii | |
| 3,552,132 | A | 1/1971 | Georgii | |
| 3,585,803 | A | 6/1971 | Bardgette | |
| 3,601,999 | A | 8/1971 | Olsen et al. | |
| 3,665,721 | A | 5/1972 | Wyllie | |
| 3,675,431 | A | 7/1972 | Jackson | |

(Continued)

FOREIGN PATENT DOCUMENTS

| | | |
|---|---|---|
| DE | 3121602 A1 | 12/1982 |
| FR | 1450410 | 6/1966 |

(Continued)

OTHER PUBLICATIONS

H.Geiger; "International Search Report"; PCT/US2010/037233; Aug. 4, 2010.

(Continued)

*Primary Examiner* — David Bagnell
*Assistant Examiner* — Kyle Armstrong
(74) *Attorney, Agent, or Firm* — Studebaker & Brackett PC; Donald R. Studebaker

(57) ABSTRACT

The grouted pile splice for pipe piles includes a lower pile section, and an upper pile section including an integral driving portion adapted to apply a driving force to the lower pile section. The upper pile section includes a stabbing portion sized to extend through a proximal end opening and into an inner bore of the lower pile section to form an annulus space between the upper pile section and the lower pile section to receive grout. The driving portion may include a wall thickness greater than a wall thickness of the stabbing portion, and an annular land positioned to contact a proximal end of the lower pile section. A grout distributor assembly may be mounted in the upper pile section to receive grout. A grout line assembly is inserted into the upper pile section and mated with the distributor assembly to supply pumped grout to the annulus space.

25 Claims, 6 Drawing Sheets

U.S. PATENT DOCUMENTS

| | | | | |
|---|---|---|---|---|
| 3,832,857 | A | 9/1974 | Bassett | |
| 3,834,168 | A | 9/1974 | Holley, Jr. | |
| 3,838,575 | A | 10/1974 | Clark et al. | |
| RE28,232 | E | 11/1974 | Bassett et al. | |
| 1,395,297 | A | 5/1975 | Reardon | |
| 3,967,451 | A * | 7/1976 | Garbe | 405/57 |
| 4,009,582 | A | 3/1977 | LeCorgne | |
| 4,070,869 | A | 1/1978 | Williams | |
| 4,698,011 | A | 10/1987 | Lamalle et al. | |
| 4,907,913 | A | 3/1990 | Saget | |
| 5,092,713 | A | 3/1992 | Salama | |
| 5,219,222 | A | 6/1993 | Babcock et al. | |
| 5,575,593 | A * | 11/1996 | Raaf | 405/237 |
| 5,934,836 | A * | 8/1999 | Rupiper et al. | 405/244 |
| 6,439,832 | B1 | 8/2002 | Siegfriedsen | |
| 6,979,171 | B2 | 12/2005 | Lauritsen | |
| 7,090,435 | B2 * | 8/2006 | Mitchell | 405/230 |
| 7,198,453 | B2 | 4/2007 | Hall | |
| 7,367,780 | B2 | 5/2008 | Kothnur et al. | |
| 7,726,913 | B1 * | 6/2010 | Sjogren | 405/232 |
| 2002/0190168 | A1 | 12/2002 | Hall et al. | |
| 2003/0151260 | A1 | 8/2003 | Siegfriedsen | |
| 2004/0141814 | A1 * | 7/2004 | Covington | 405/230 |
| 2004/0169376 | A1 | 9/2004 | Ruer et al. | |
| 2005/0163616 | A1 | 7/2005 | Mortensen | |
| 2006/0067794 | A1 * | 3/2006 | Mitchell | 405/230 |
| 2006/0115364 | A1 | 6/2006 | Hall et al. | |
| 2008/0313972 | A1 | 12/2008 | Grob et al. | |
| 2009/0212757 | A1 | 8/2009 | Su | |

FOREIGN PATENT DOCUMENTS

| | | | |
|---|---|---|---|
| GB | 2157751 | A * | 10/1985 |
| GB | 2254638 | A | 10/1992 |
| NL | 1031849 | | 11/2007 |
| WO | 98/00609 | | 1/1998 |

OTHER PUBLICATIONS

H. Geiger; "Written Opinion of the International Search Authority"; PCT/US2010/037233; Aug. 4, 2010.

* cited by examiner

GROUTED PILE SPLICE AND METHOD OF FORMING A GROUTED PILE SPLICE

BACKGROUND

1. Technical Field

These inventions generally relate to pile splices. In particular, these inventions relates to pile splices and methods of, for example, offshore foundations employing large diameter long steel pipe piles installed in sections, or the like.

2. Description of the Related Art

Conventional offshore foundations employ vertical or battered large diameter long steel pipe piles. These pipe pile foundations have been used to support offshore platforms for over 60 years. As platforms grew in size to support loads from larger topsides, the diameter and length of piles increased. In order to install the larger piles in the offshore structure, which serves as a pile template, and drive the piles to deeper penetrations, the piles must be built in sections and the sections joined together at pile splice(s), generally carried on site. This splice is typically a welded connection made on site during the driving sequence of the platform foundation installation. In more recent times, mechanical connectors for smaller diameter pipe have been employed. But mechanical connectors typically require the upper pile section to be rotated to join the pile sections together at the splice, and the rotation requirement is normally not practical for battered piles. The welding of pile splices can be a significant cost component to the platform installation due to the time and costs of personnel and equipment to perform the tasks associated with welding and, subsequently, inspecting the weld at the site.

SUMMARY

An embodiment consistent with the claimed inventions includes a grouted pile splice, comprising a lower pile section including a proximal end, a proximal end opening, an inner surface, and an inner bore. The splice also includes an upper pile section including an integral driving portion adapted to apply a driving force to the lower pile section. The upper pile section includes a stabbing portion sized to extend through the proximal end opening and into the inner bore of the lower pile section to form an annulus space between the upper pile section and the inner surface of the lower pile section. The annulus space is sized to receive grout to connect the upper pile section and the lower pile section. The driving portion may include a wall thickness greater than a wall thickness of the stabbing portion, and an annular land positioned to contact a proximal end of the lower pile section.

The grouted pile splice may further include a grout distributor assembly mounted in the upper pile section to receive grout to connect the driving pile to the lower pile section. The stabbing portion may include an opening to permit fluid flow through the stabbing portion. The grout distributor assembly may include relief passages to permit fluid flow from the opening through the stabbing portion. The grout distributor assembly may include an upper section rigidly connected to an inside surface of the upper pile section and a lower section connected to the upper section and mounted for axial movement along a longitudinal axis of the upper pile section. The grouted pile splice may also include a lateral guide connected to the inside surface of the upper pile section and extending radially inwardly to provide lateral support to the lower section. The upper section and the lateral guide may each include relief passages to permit fluid flow through the upper pile section. The stabbing portion may include grout return holes positioned to permit grout to flow from the annulus space into the stabbing portion.

Another embodiment consistent with the claimed inventions includes a method of forming a grouted pile splice including providing a lower pile section including a proximal end opening, an inner surface, and an inner bore, and providing an upper pile section including a stabbing portion sized to extend through the proximal end opening and into the inner bore of the lower pile section to form an annulus space between the upper pile section and the inner surface of the lower pile section. The method also includes inserting the upper pile section through the proximal end opening and into the inner bore of the lower pile section, and driving the upper pile section against the lower pile section with the upper pile section inserted into the lower pile section to cause the upper pile section to apply a driving force to the lower pile section sufficient to move the lower pile section into a support surface. The method also includes supplying grout to the annulus space to connect the upper pile section and the lower pile section. The method may also include driving of the upper pile section against the lower pile section without a rigid connection of the upper pile section and the lower pile section. The method may also include providing a grout distributor assembly mounted in the upper pile section, and inserting a grout line assembly into the grout distributor assembly prior to supplying grout to the annulus space. Supplying grout to the annulus space may occur after the driving of the upper pile section against the lower pile section. The method may also include providing a grout distributor assembly mounted in the upper pile section that includes an upper section rigidly connected to an inside surface of the upper pile section and a lower section connected to the upper section and mounted for axial movement along a longitudinal axis of the upper pile section.

An embodiment of the claimed inventions also includes a driving pile section comprising an elongated cylindrical body including a distal end portion sized for insertion into another pile section and a driving portion adjacent the distal end portion. The driving pile section also includes a driving portion having a size and shape to abut the another pile section to apply a driving force to the another pile section, and a grout distributor assembly mounted in the cylindrical body to receive grout to connect the driving pile section to the another pile section. The driving portion may include an outer diameter greater than an outer diameter of the distal end portion. The driving portion may also include an annular land for contacting an end of the another pile section. The distal end portion may include an opening to permit fluid flow through the cylindrical body and the grout distributor assembly may include relief passages to permit fluid flow from the opening through the cylindrical body.

DETAILED DESCRIPTION

Exemplary embodiments consistent with the claimed inventions will be described in relation to a pipe pile splice connected by grout injected between the annulus space formed between an upper pile and a lower pile at the splice. However, to avoid unnecessarily obscuring the embodiments of the claimed inventions, the following description omits details of well known structures and devices that may be shown in block diagram form or otherwise summarized. For the purpose of explanation, numerous specified details are set forth in order to provide a thorough understanding of exemplary embodiments. It should be appreciated that the embodiments may be practiced in a variety of ways beyond these specified details. Furthermore, while exemplary distances, dimensions, and scales are shown in the figures, it is to be appreciated that the distances, dimensions and scales of the system and methods presented herein can be varied to fit any particular implementation, which may include oil drilling platform and wind turbine support applications.

Figure 1:
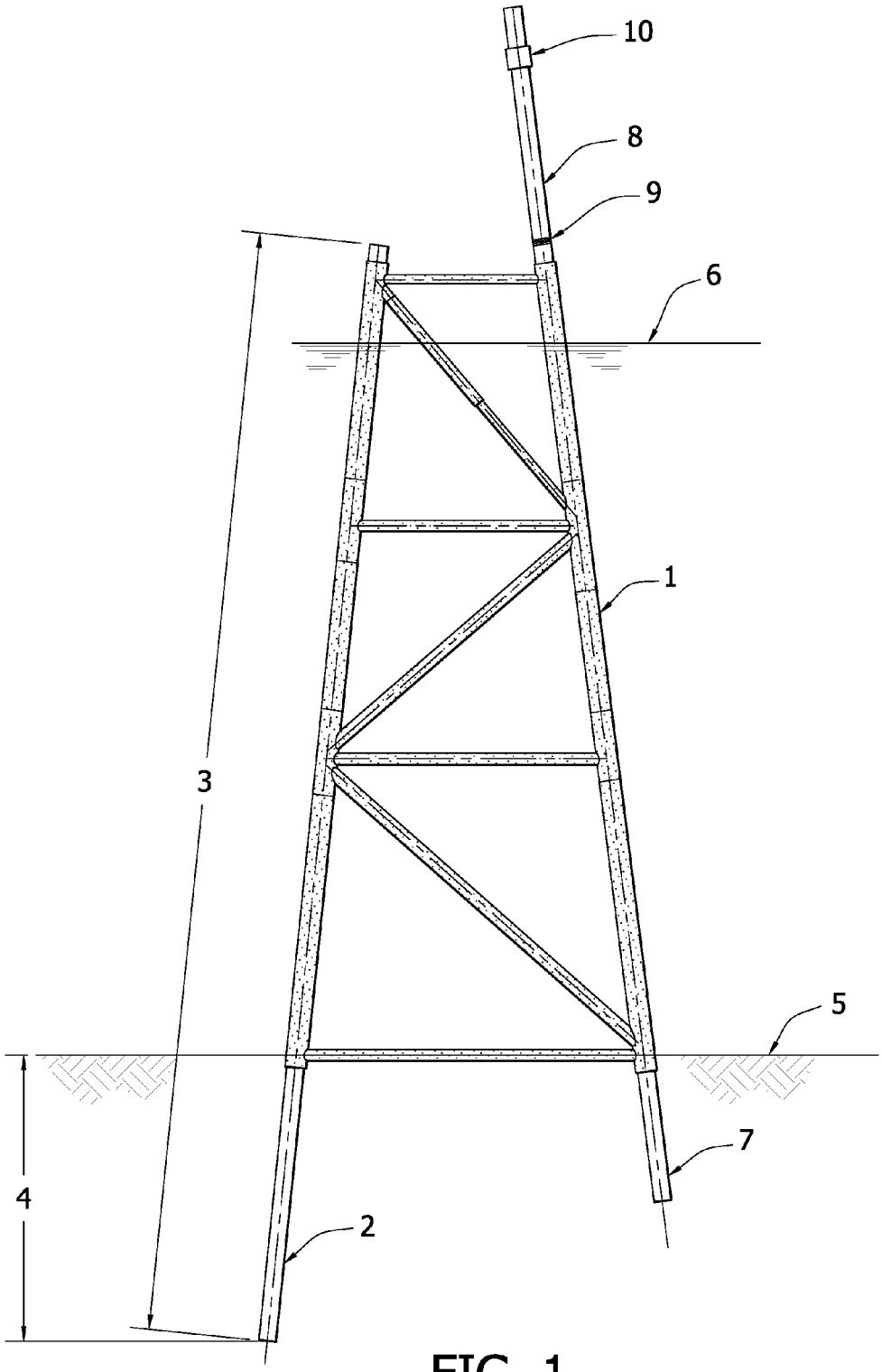
FIG. 1 is a view in side elevation of an offshore template type structure depicting both a fully installed pile and a partially installed pile generally showing the pile splice, in accordance with exemplary embodiments, between the upper and lower pile sections.

FIG. 1 shows an offshore template type structure, indicated generally at 1, including the grouted pile splice and driving pile section of the exemplary embodiments. Specifically, a battered pipe pile 2, having a total length of 3 with a penetration distance 4 below a mudline 5, extends above a water surface 6. A second partially installed pipe pile having a lower pile section 7, an upper pile section 8, and pile splice 9, connecting sections 7 and 8, is depicted in a driving sequence with a pile driving hammer 10 engaged on top of the upper pile section 8 to apply a driving force, for example, multiple driving forces generated by multiple respective impacts of hammer 10, against upper pile section 8. It should be noted that the present methods and splices can be carried out for both vertical and battered piles.

Figure 2:
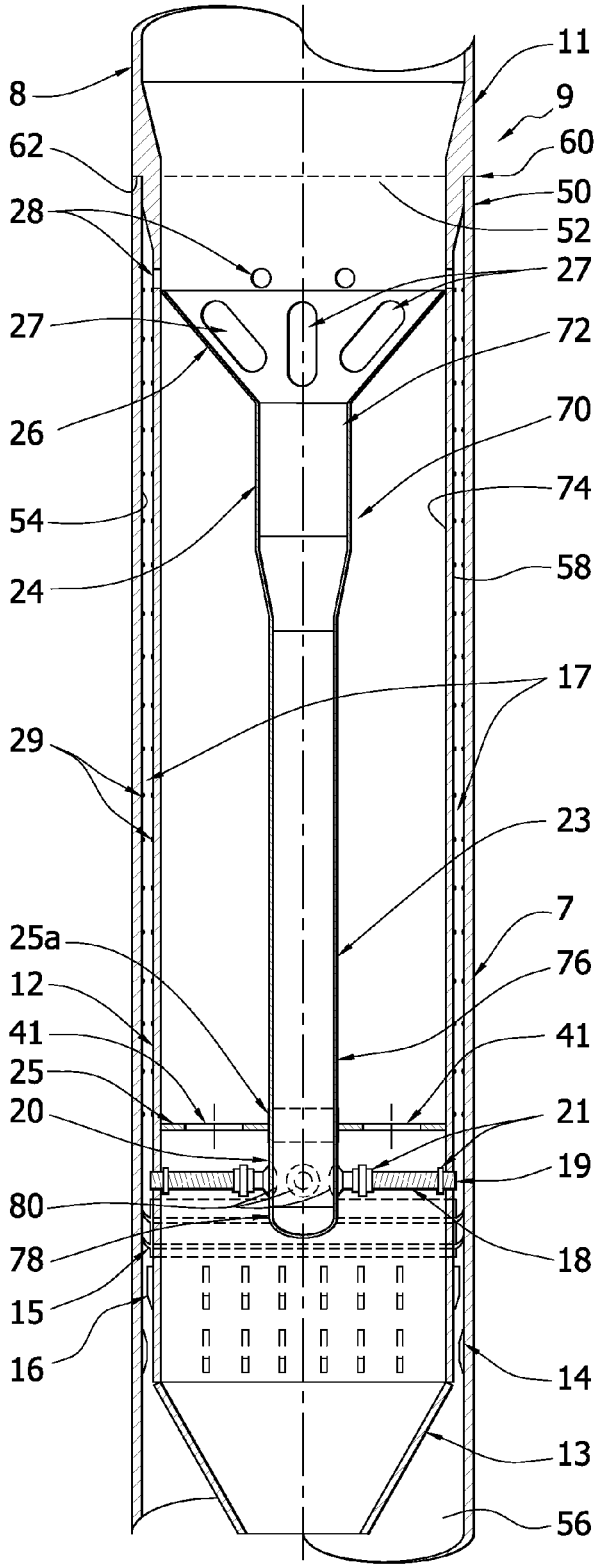
FIG. 2 is a cut away cross-sectional view in elevation of the grouted pile splice according to an exemplary embodiment.

FIG. 2 shows, in a cut away cross-sectional view, an exemplary embodiment of the grouted pile splice consistent with the claimed inventions including the upper pile section 8 having an integral driving head or portion 11 seated on lower pile section 7 to form an interface 60 at pile splice 9. Driving head or portion 11 is integrally formed on upper pile splice 8 to provide greater strength at pile splice 9 than portions of upper pile section 8 above and below pile splice 9. For example, in the exemplary embodiment, driving portion 11 is formed with a radial wall thickness immediately above and at interface 60 at pile splice 9, and preferably below interface 60, for a predetermined longitudinal distance, greater than the wall thickness of a stabbing guide 12 (discussed below) and preferably greater than an upper portion of upper pile section 8 to provide the strength necessary to withstand the driving forces generated by hammer 10 and effectively apply, transfer, and distribute those forces to lower pile section 7. In the present exemplary embodiment, stabbing guide 12 and driving portion 11 are formed from a one-piece pipe dimensioned appropriately by milling operations during manufacture. However, in another exemplary embodiment of FIG. 5*a*-7, the driving portion and stabbing guide are formed separately and then rigidly and integrally connected to one another and to another pipe, for example, by welding during manufacture prior to transport to the site, and to form upper pile section 8.

In the present embodiment, lower pile section 7 includes a proximal end 50, a proximal opening 52, an inner surface or wall 54, and an inner bore 56. Upper pile section 8 is formed as a generally elongated cylindrical body including a distal end or pile stabbing portion/guide 12, having a stabbing cone 13, which is sized for insertion into inner bore 56 of lower pile section 7 to form an annulus space 17 between inner surface 54 of lower pile section 7 and the outside wall or surface 58 of pile stabbing guide 12. In the exemplary embodiment, stabbing cone 13 extends below centralizers 14 welded to the inner surface 54 of lower pile section 7 to guide pile stabbing guide 12 into position. Typical wiper type grout seals 15, located above the typical grout seal protector shims 16, seal off the lower end of annulus space 17. Stabbing cone 13 includes an opening to permit fluid flow into stabbing guide 12. Driving portion 11 includes an outer diameter greater than an outer diameter of pile stabbing guide 12 and also includes an annular land 62 extending transverse to the longitudinal axis of the grouted pile splice and facing proximal end 50 of lower pile section 7 for annular contact and abutment against proximal end 50.

A grout distributor assembly 70 is mounted in pile stabbing guide 12 of upper pile section 8 to receive and direct grout into annulus space 17. Grout distributor assembly 70 includes an upper section 72 rigidly connected to inside surface 74 of stabbing guide 12 and a lower section 76 extending from upper section 72. Upper section 72 includes a support cone and grout return chute 26 rigidly secured, i.e. welded, at an upper edge to the inside wall of pile stabbing guide 12. Upper section 72 also includes a grout line receptacle 24 secured, i.e. welded, to the support cone and grout return chute 26 and extending downwardly. Lower section 76 includes a distributor 20 and a down comer 23 extending between grout line receptacle 24 and grout distributor 20. Distributor 20 includes a closed end portion 78, multiple outlets 80 formed in end portion 78, and flexible grout hoses 18. Flexible grout hoses 18 include connections 21, i.e. threaded fittings, connected at respective outlets 80 at one end and connected at an opposite end to respective grout ports 19 formed in pile stabbing guide 12. Flexible hoses 18 permit down comer 23 and distributor 20 to move axially relative to pile stabbing guide 12 during the application of driving forces by upper pile section 8 against lower pile section 7. Grout distributor down comer 23 is supported laterally by a grout distributor guide plate or lateral guide 25 fixed, i.e. welded, to the inside wall of the pile stabbing guide 12 and including a passage formed therein. A guide sleeve 25*a* is mounted in the passage and fixed to plate 25 but sized to provide lateral support to down comer 23 without hindering axial movement thereby permitting grout distributor down comer 23 to slide up and down through sleeve 25*a*. Thus, since lower section 76 of down comer 23 is not rigidly connected to the lower portion of stabbing guide 12 by, for example, avoiding welded connections, i.e. only supported laterally/transversely by sleeve 25*a* and connected by flexible hoses 18, relative axial movement between stabbing guide 12 and lower section 76, caused by driving force induced stress waves in these components, is permitted free from or without any restriction thereby minimizing the likelihood of stress wave induced damage to the components and avoiding damage to welded connections that are not used. The length of grout distributor down comer 23 is determined to prevent grout back flow from annulus space 17 between lower pile section 7 and pile stabbing guide 12 after grout line assembly 36 (discussed below) is retracted from the pile.

Hydro relief holes or passages 27, 41 are provided in support cone and grout return chute 26 and grout distributor guide plate 25, respectively, to permit water to flow through stabbing guide 12 during installation and driving when stabbing cone 13 is below the water surface 6. Relief holes 27, 41 are sized such that the total cross-sectional flow area of a respective set of relief holes 27, 41 in the chute 26 and plate 25 is large enough to permit the free flow of water through stabbing guide 12 to prevent any water pressure induced resistance to the insertion of the piles and any buildup of water pressure. Also, grout return ports or holes 28 are formed in an array around pile stabbing guide 12 above support cone and grout return chute 26 adjacent the top of annulus space 17 and below land 62 to allow grout to flow up through the annulus space 12 and out into a collection container (discussed hereinbelow) for return to the surface and subsequent analysis. Weld beads 29 are applied to the inside wall of the lower pile section 7 and the outside wall of the pile stabbing guide 12 to function as shear keys in order to minimize the required grouted length of the annulus space.

Figure 3:
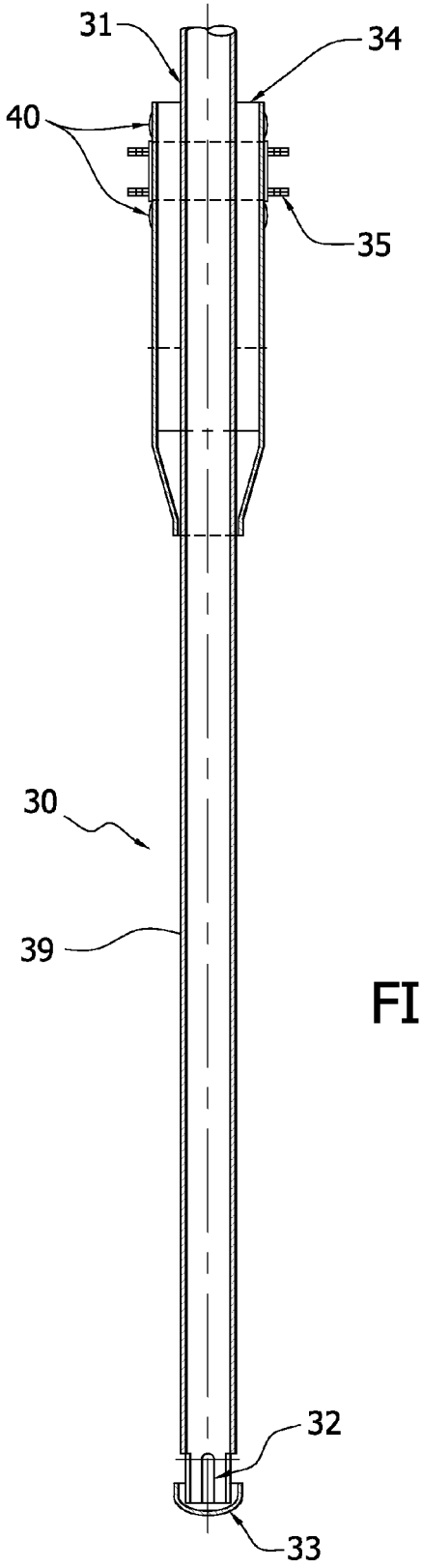
FIG. 3 is a cut away cross-sectional view in elevation of a lower grout line assembly stinger tip and grout sample collection container according to the exemplary embodiment of FIG. 2.

FIG. 3 shows, in a cut away cross-sectional view, a stinger tip section 30 of a grout line 31 to be inserted into the open end of the upper pile section 8, moved into inner bore 56 of lower pile section 7, and mated with grout line receptacle 24, down comer 23, and closed end portion 78 of distributor 20. The bottom of stinger tip section 30 includes slots 32 to allow grout flow out of an elongated section 39 and into closed end portion 78 and then into multiple outlets 80. The end of tip section 30 is protected with a tip guard 33 to prevent the tip from hanging up or jamming in upper pile section 8 or hydro relief holes 27 during insertion and retrieval/retraction. A grout sample collection container 34 is welded to the outside surface of the wall of stinger tip section 30 forming an annular gap or container cavity to collect grout returning from annulus space 17 via return ports 28 for retrieval to the surface. Retrieved grout samples can then be transferred to test cylinders for later verification of grout strength. The grout sample collection container 34 has typical grout wiper blade seals 35 at the top to force grout circulation into the annulus space and to prevent grout back flow through the space formed between grout line receptacle 24 and grout sample collection container 34. Seal protector shims 40 are used above and below seals 35 to deflect other components during movement of tip section 30 thereby preventing inadvertent damage and/or removal of seals 35.

Figures 4A, 4B, 4C, 4D:
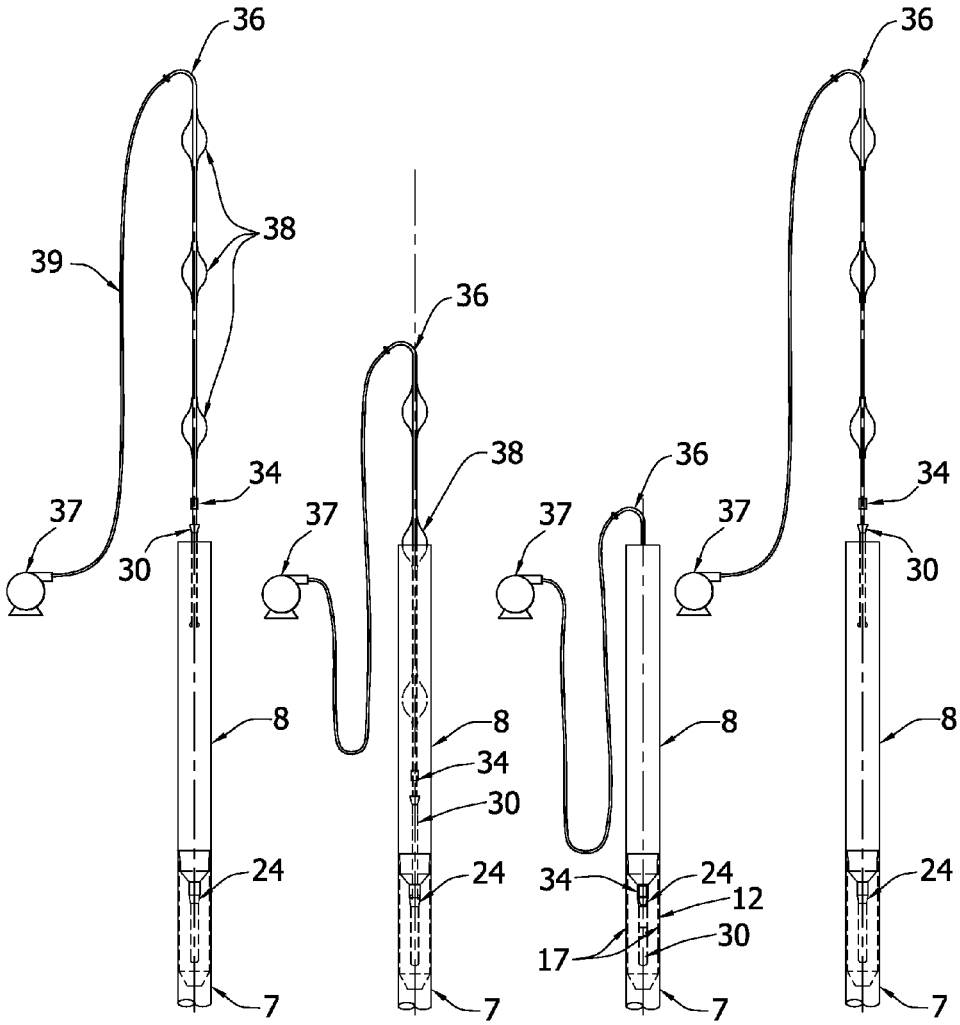
FIG. 4 is a series of views in side elevation showing the method of lifting, inserting, mating and retrieving the grout line assembly according to an exemplary embodiment.
Figure 5A:
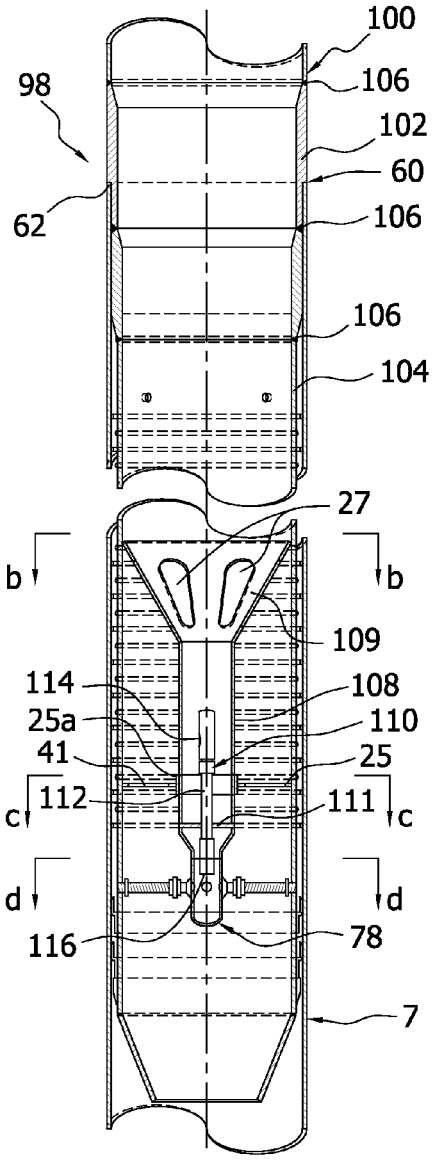
FIG. 5*a* is a cut away cross-sectional view in elevation of the grouted pile splice according to another exemplary embodiment.
Figure 5B:
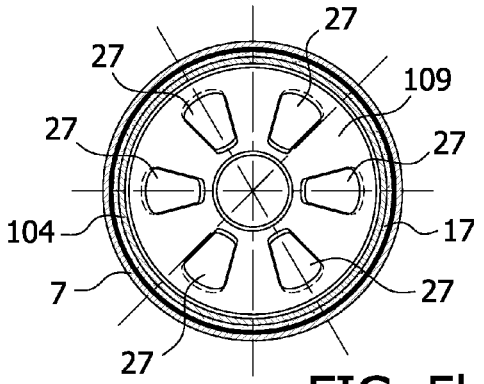
FIGS. 5*b*, 5*c* and 5*d* are cross-sectional views of the grouted pile splice of FIG. 5*a* taken along respective planes.
Figure 5C:
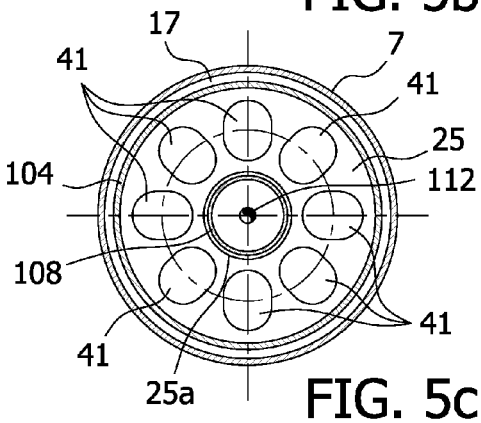
Figure 5D:
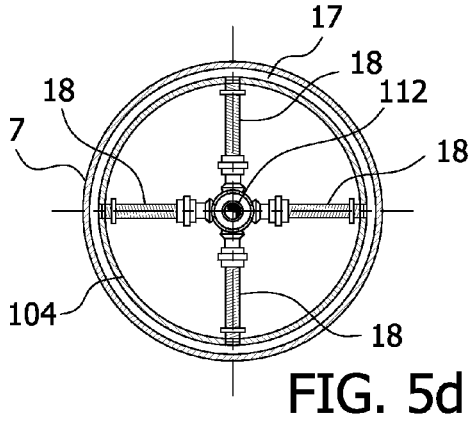
Figure 6:
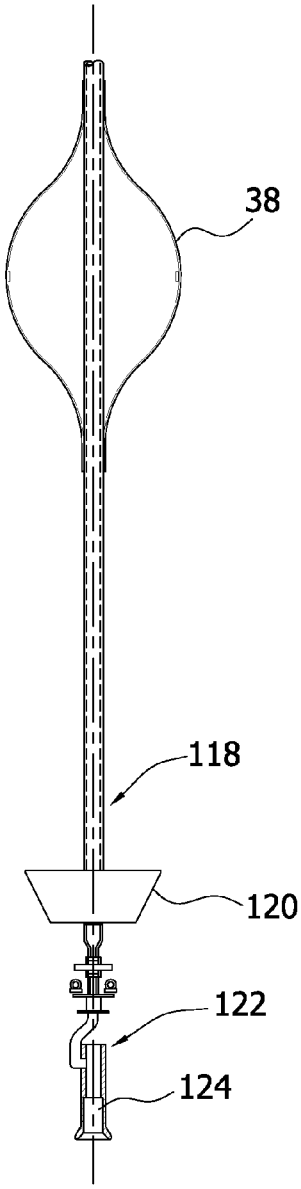
FIG. 6 is a cut away cross-sectional view in elevation of a lower grout line assembly stinger tip according to the exemplary embodiment of FIG. 5*a*.

FIGS. 4*a*-4*d* depict, in a series of illustrations, stages of the grouting procedure of an exemplary embodiment. As shown in FIG. 4*a*, a grout line assembly 36, connected by a hose 39 to a grout pump 37, is lifted above upper pile section 8. Grout line assembly 36 includes stinger tip section 30, grout sample collection container 34, and flexible clamp-on centralizers 38 to align stinger tip section 30 with grout line receptacle 24. Centralizers 38 reduce the potential of grout line assembly 36 becoming jammed against the pile during insertion and retrieval and to provide better alignment of grout line stinger tip section 30 with the grout receptacle during insertion. Grout line assembly 36 is inserted into upper pile section 8 (FIG. 4*b*) until stinger tip section 30 is completely mated with grout line receptacle 24 (FIG. 4*c*). Grout is then pumped from grout pump 37 through grout line assembly 36 into annulus space 17 formed between the inside wall of lower pile section 7 and the outside wall of pile stabbing guide 12. Overflow grout returns are collected in grout sample collection container 34. After a precalibrated amount of grout is pumped, grout pump 37 is shut down and grout line assembly 36 is retracted from upper pile section 8 (FIG. 4*d*). Grout returns collected in grout sample collection container 34 may be removed for testing.

Figure 7:
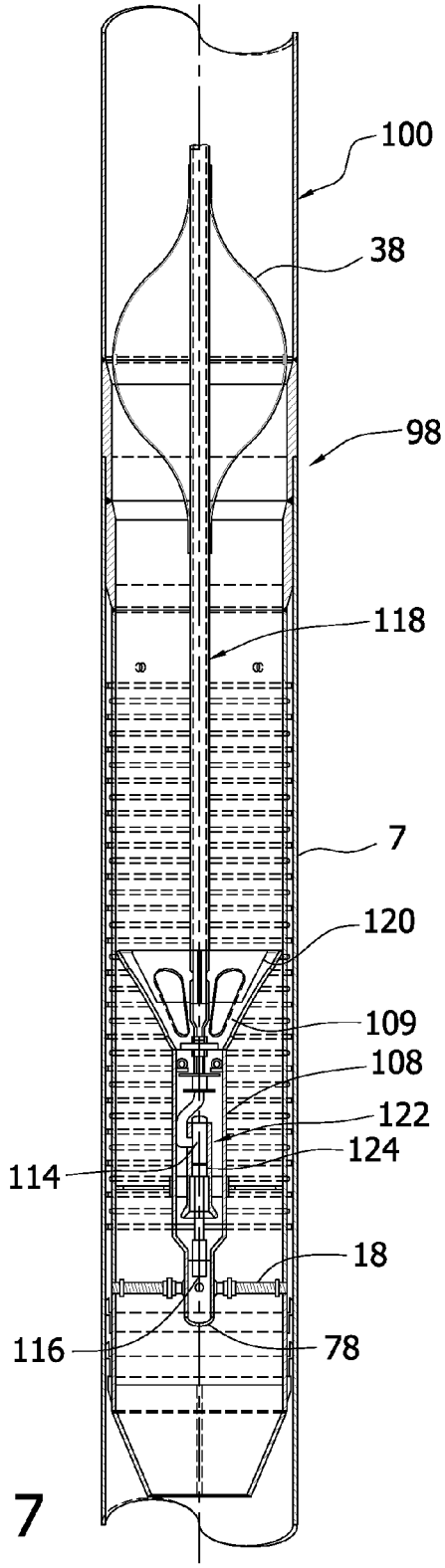
FIG. 7 is a cut away cross-sectional view in elevation of the stinger tip of FIG. 6 inserted into the pile splice of FIG. 5*a*.

FIGS. 5*a*-5*b* and FIGS. 6-7 show another embodiment consistent with the claimed inventions which is similar to the embodiment of FIGS. 1-4*d*. As a result, the same or substantially similar features and components of the embodiments are identified with the same references numerals and discussion of those features and components is omitted. The present embodiment differs from the previous embodiment in several ways. First, a pile splice 98 includes an upper pile section 100 including a driving portion 102 and a stabbing guide 104 formed from separate pipe sections which are then rigidly and integrally connected to one another and to an upper pipe by, for example, welding to form welded connections 106 during manufacture prior to transport to the site. This embodiment also uses a shorter down comer 108, a support cone 109 that does not function as a grout return chute, and a connector 110 mounted in down comer 108 by a transverse plate 111 with a central passage. Connector 110 includes elongated piping 112 having an upper transverse inlet 114 and a lower outlet 116 for directing grout to closed end portion 78. In addition, a stinger tip section 118 does not include a grout line receptacle but does include an annular centering cone 120 for assisting in the alignment of the lower end of stinger tip section 118 during insertion. Stinger tip section 118 also includes connector receiver assembly 122, comprised of piping and a connector receiver 124 to slidably and telescopingly receive and connect with connector 110 to deliver grout to connector 110 as shown in FIG. 7. It should be noted that the relief holes 27, 41 that are clearly shown in the present embodiment as an array of holes equally spaced annularly around the cone 120 and plate 25 respectively, (FIGS. 5*b* and 5*c*), and the flexible hoses 18, are the same or similar to the relief holes and hoses mentioned in the previous embodiment. Also, centering cone 120 is sized, shaped, positioned so as not to interfere with the water flow/relief function of holes 27, 41.

Thus, an initial pile section is mated with the subsequent pile section, and the initial pile section driven to final penetration into a support surface using the subsequent pile section, where the subsequent pile section includes the combination of a pile stabbing guide, grout distributor assembly, and an integral driving portion or head. After the vertical or battered pile(s) is/are driven to final penetration without a rigid connection, e.g. welded connection or fastener connection, between the lower and upper pile sections, grout line assembly 36, having a stinger-tip with seals, can be lowered into the subsequent or upper pile section and mated with the grout line receptacle mounted in the upper pile section stabbing guide to allow grout to be pumped through the grout distributor into the annulus space between the upper pile stabbing guide and the lower pile to thereby rigidly connect the upper pile section to the lower pile section upon hardening or curing of the grout.

The grouted pile splices and methods consistent with the claimed inventions offer various advantages, including the following. The full forces and moments developed in the pile during normal operating and extreme loading events are transmitted across the pile splice(s) such that the grouted connection between the pile sections can develop the full strength of the pile. Thus the pile splice can resist the forces and moments developed in the pile during normal and extreme loading events. Also, this splice and method significantly reduce the time required for joining the pile sections when compared to using the conventional welded connection methods since the pile splice and method of the embodiments herein does not include, or is devoid of, a welded connection between the upper and lower pile sections. In addition, the support framing of the grout distributor allows the stress wave developed during the driving to pass through the support framing without causing welded connections to fail. The hydro relief holes in the support cone and grout distributor guide allow water pressure developed inside the pile during driving to be relieved across the support cone and grout distributor guide. Moreover, the grout line assembly can be used to retrieve over flow grout from the upper grout return ports that flows down the grout return chute (support cone) into the grout sample collection container attached above the stinger tip section of the grout line assembly.

It is therefore apparent that there has been provided, in accordance with the present invention, a grouted pile splice and method for grouting the pile splice. While this invention has been described in conjunction with a preferred embodiment, it is evident that many alternatives, modifications, and variations would be or are apparent to those of ordinary skill in the application arts. Accordingly, the disclosure is intended to embrace all such alternatives, modifications, equivalents and variations that are within the spirit and scope of this invention.

I claim:

1. A grouted pile splice, comprising:

a lower pile section including a proximal end, a proximal end opening, an inner surface, and an inner bore;

an upper pile section including an elongated integral upper body portion, a stabbing portion and an integral driving portion disposed between the elongated integral upper body portion and the stabbing portion along a longitudinal axis of the upper pile section, the elongated integral upper body portion, the integral driving portion and the stabbing portion being formed as a single piece, the integral driving portion being adapted to apply a driving force to said lower pile section, the stabbing portion being sized to extend through said proximal end opening and into said inner bore of said lower pile section to form an annulus space between said upper pile section and said inner surface of said lower pile section, said annulus space sized to receive grout to connect said upper pile section and said lower pile section; and a grout distributor assembly mounted in the upper pile section to receive grout and supply the grout from the distributor assembly to the annulus space to connect the upper pile section to said lower pile section, the grout distributor assembly having a proximal end connected to an inside surface of the stabbing portion.

2. The grouted pile splice of claim 1, wherein said driving portion includes a wall thickness greater than a wall thickness of said stabbing portion.

3. The grouted pile splice of claim 2, wherein said driving portion includes an annular land positioned to contact a proximal end of said lower pile section.

4. The grouted pile splice of claim 1, wherein said stabbing portion includes an opening to permit fluid flow through a space between said stabbing portion and the grout distributor assembly, and said grout distributor assembly includes at least one relief passage to permit the fluid flow from said opening through the space between said stabbing portion and the grout distributor assembly.

5. The grouted pile splice of claim 1, wherein the grout distributor assembly includes an upper section connected to the inside surface of the stabbing portion of said upper pile section and a lower section connected to said upper section of the grout distributor assembly and mounted for axial movement along the longitudinal axis of said upper pile section.

6. The grouted pile splice of claim 5, further including a lateral guide connected to said inside surface of said upper pile section and extending radially inwardly to provide lateral support to said lower section of the grout distributor assembly.

7. The grouted pile splice of claim 6, wherein said upper section of the grout distributor assembly and said lateral guide each include relief passages to permit fluid flow through said upper pile section.

8. The grouted pile splice of claim 1, wherein said stabbing portion includes grout return holes positioned to permit grout to flow from said annulus space into said stabbing portion.

9. The grouted pile splice of claim 1, wherein the integral driving portion of the upper pile section is formed as a separate portion from the stabbing portion and rigidly and integrally connected to the stabbing portion.

10. The grouted pile splice of claim 1, wherein the proximal end of the grout distributor assembly is connected to the inside surface of the stabbing portion between the proximal end of the lower pile section and a distal end of the stabbing portion along the longitudinal axis of the upper pile section.

11. The grouted pile splice of claim 1, further comprising a seal portion located between an inner surface of the lower pile section and an outside surface of the stabbing portion to seal off a lower end of the annulus space.

12. The grouted pile splice of claim 1, wherein the stabbing portion has a distal closed end.

13. The grouted pile splice of claim 1, wherein the stabbing portion includes at least one grout port;

the grout distributor assembly has at least one outlet and at least one hose portion connecting the at least one grout port and the at least one outlet; and the grout is supplied from the grout distributor assembly to the annulus space.

14. A method of forming a grouted pile splice, comprising:

providing a lower pile section including a proximal end opening, an inner surface, and an inner bore;

providing an upper pile section including an elongated upper body portion and an integral stabbing portion extending from the elongated upper body portion along a longitudinal axis of the upper pile section, the elongated upper body portion and the integral stabbing portion being formed as a single piece, the integral stabbing portion being sized to extend into said proximal end opening and into said inner bore of said lower pile section to form an annulus space between said upper pile section and said inner surface of said lower pile section;

providing a grout distributor assembly mounted in the upper pile section to receive grout, the grout distributor assembly having a proximal end connected to the integral stabbing portion of the upper pile section;

inserting said integral stabbing portion of said upper pile section through said proximal end opening and into said inner bore of said lower pile section;

driving said upper pile section against said lower pile section with said upper pile section inserted into said lower pile section to cause said upper pile section to apply a driving force to said lower pile section sufficient to move said lower pile section into a support surface; and supplying the grout to said annulus space to connect said upper pile section and said lower pile section.

15. The method of claim 14, wherein said driving of said upper pile section against said lower pile section occurs without a rigid connection of said upper pile section and said lower pile section.

16. The method of claim 14, further including inserting a grout line assembly into said grout distributor assembly prior to supplying grout to said annulus space.

17. The method of claim 14, wherein supplying grout to said annulus space occurs after said driving of said upper pile section against said lower pile section.

18. The method of claim 14, wherein the grout distributor assembly includes an upper section connected to an inside surface of the stabbing portion of said upper pile section and a lower section connected to said upper section of the grout distributor assembly and mounted for axial movement along the longitudinal axis of said upper pile section.

19. A driving pile section, comprising:

an elongated cylindrical body including an elongated integral upper body portion, an integral distal end portion sized for insertion into another pile section, and an integral driving portion integrally formed on said integral upper body portion and disposed between the elongated integral upper body portion and the integral distal end portion along a longitudinal axis of the elongated cylindrical body and adjacent said distal end portion, the elongated integral upper body portion, the integral driving portion, and the distal end portion being formed as a single piece, said driving portion having a size and shape to abut the another pile section to apply a driving force to the another pile section; and a grout distributor assembly mounted in said elongated cylindrical body to receive grout and supply the grout to an annulus space between the elongated cylindrical body and an inner surface of the another pile section to connect the driving pile section to the another pile section, the grout distributor assembly having a proximal end connected to an inside surface of the integral distal end portion of the elongated cylindrical body.

20. The driving pile section of claim 19, wherein said driving portion includes an outer diameter greater than an outer diameter of said distal end portion of the elongated cylindrical body.

21. The driving pile section of claim 20, wherein said driving portion includes an annular land for contacting an end of the another pile section.

22. The driving pile section of claim 19, wherein said distal end portion includes an opening to permit fluid flow through a space between the distal end portion and the grout distributor assembly of said elongated cylindrical body, said grout distributor assembly including relief passages to permit the fluid flow from said opening through the space between the distal end portion and the grout distributor assembly of said elongated cylindrical body.

23. The driving pile section of claim 19, wherein said grout distributor assembly includes an upper section connected to an inside surface of the distal end portion of said elongated cylindrical body, and a lower section connected to said upper section of the grout distributor assembly and mounted for axial movement along a longitudinal axis of said elongated cylindrical body.

24. The driving pile section of claim 23, further including a lateral guide connected to said inside surface of the distal end portion of said elongated cylindrical body and extending radially inwardly to provide lateral support to said lower section of the grout distributor assembly.

25. The driving pile section of claim 24, wherein said upper section of the grout distributor assembly and said lateral guide each include relief passages to permit fluid flow through a space between the distal end portion and the grout distributor assembly of said elongated cylindrical body.

* * * * *